US005572840A

United States Patent [19]

Fast et al.

[11] Patent Number: 5,572,840

[45] Date of Patent: Nov. 12, 1996

[54] WINDOW FRAME WITH HINGED NAILING STRIP

[76] Inventors: William A. Fast; Richard M. Desautels, both of 485 Watt Street, Winnipeg, Manitoba, Canada, R2L 2A5; David R. Campbell, 781 Lakeland Avenue, Stroud, Ontario, Canada, L0L 2M0

[21] Appl. No.: 379,395

[22] Filed: Jan. 27, 1995

[51] Int. Cl.[6] ..... E06B 1/04

[52] U.S. Cl. ..... 52/213; 52/204.55; 52/143; 49/504

[58] Field of Search ..... 52/204.55, 213, 52/214, 143, 65; 49/380, 504

[56] References Cited

U.S. PATENT DOCUMENTS 3,473,266 10/1969 Miller .
4,274,235 6/1981 Langenhorst .
4,578,905 4/1986 Hout .
4,821,472 4/1989 Tix .
4,958,469 9/1990 Plummer .
4,999,957 3/1991 Kessler .
5,119,609 6/1992 Tait et al. .

FOREIGN PATENT DOCUMENTS 1331258 of 1963 France ..... 52/213

*Primary Examiner*—Robert Canfield

[57] ABSTRACT

A window frame profile for forming into a window frame with a number of other similar profiles includes a separate nailing strip extruded from aluminum and attached to the outer surface of the frame profile. The nailing strip includes a planar strip member and a cylindrical bead portion along one side edge of the strip member. The bead is snap fastened into a cylindrical recess in the outer surface of the frame allowing rotation of the strip about the axis of the bead from a retracted position for transport in which the strip is received in a flat recess on the outer surface. The strip can be rotated from the retracted storage position to an erect position at right angles to the outer surface by rotation about the axis of the bead and snap fastened in the erect position.

15 Claims, 3 Drawing Sheets

WINDOW FRAME WITH HINGED NAILING STRIP

BACKGROUND OF THE INVENTION

This invention relates to a window frame for mounting in an opening defined by a framing support structure of a building, the window frame comprising a plurality of elongate frame members connected together at corners of the window frame, each member having an inner surface facing inwardly toward an opposed one of the members and an outer surface opposed to the inner surface for engaging the frame support structure, the inner surface having glazing support members thereon and the outer surface having a nailing strip mounted thereon for extending along the length of the outer surface outwardly therefrom substantially at right angles for attachment to the framing support structure along an edge of the opening.

Window frames of this type are widely used and are generally shipped from the manufacturer in completed construction, sometimes but not always including the glazing.

On site the window frame is inserted into the opening formed in the framing of the building from the outside until the nailing strip which extends outwardly from the outer surface of the window frame engages the outer surface of the building. The nailing strip is then attached to the outer surface by nails or other fasteners to hold the window frame in place.

The nailing strip has a number of disadvantages. Firstly in shipping, the nailing strip projects outwardly from the outermost edge of the window frame and thus is exposed for damage and also increases the dimensions of the window frame thus increasing shipping costs.

Furthermore when the window frame is manufactured from extruded plastics material such as vinyl, the nailing strip is extruded commonly with the window frame lineal and thus also is of course formed from vinyl. The vinyl nailing strip has a tendency to crack if impacted excessively during the nailing process, particularly when frozen.

One proposal to reduce the problems of the nailing strip is shown in U.S. Pat. No. 4,821,472 (Tix) assigned to Plastic Profiles, Inc. and issued on Apr. 18, 1989. This patent shows a nailing strip which has a first portion attached to the outer surface of the window frame member, a second portion defining the planar strip member for nailed attachment to the framing structure of the building and a flexible portion interconnecting the first and second portions allowing the second portion to flex from the erect position at right angles to the outer surface to a transport position lying generally parallel to the outer surface. This movement is obtained by flexing of material of the flexible portion rather than by hinged rotation of two separate sections of the portions. The nailing strip including the two portions and the flexible interconnecting portion are coextruded from a plastics material. In the above patent the window frame is manufactured from wood and the nailing strip from plastics material which is inserted into a slot in the wooden frame. However it could be expected that the window frame could be manufactured from vinyl in extruded form in which case it would be expected that the nailing strip would be coextruded with the vinyl window frame as an integral element.

While the arrangement above to some extent solves the problems of the nailing strip, it does not overcome the problem of cold weather cracking and does not mount the nailing strip to the best advantage for movement between the transport and erect positions.

SUMMARY OF THE INVENTION

It is one object of the present invention therefore to provide an improved window frame of the above type including a nailing strip of an improved construction.

According to the invention there is provided a nailing strip which is formed from aluminum so as to be more resistant to cracking and this is attached to the vinyl frame member by an edge bead of the strip which is inserted into a cylindrical recess in the frame member and is therefore rotatable in the recess about a longitudinal axis of the frame to move from a retracted transport position flat against the outer surface of the frame member to an erect position at right angles to the outer surface for acting as a nailing strip against a wall of the building.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
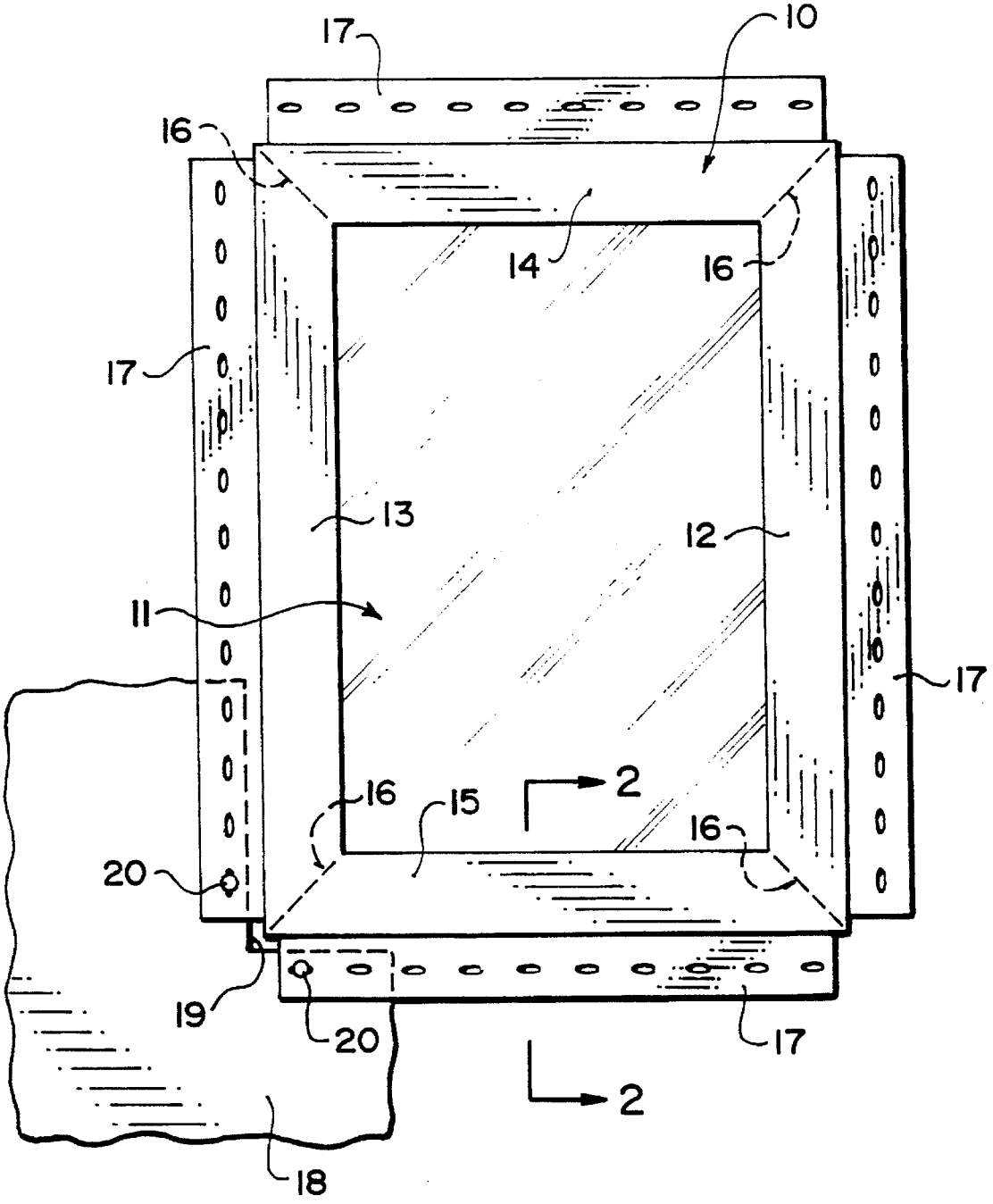
FIG. 1 is a front elevational view of a window frame according to the present invention.
Figure 2:
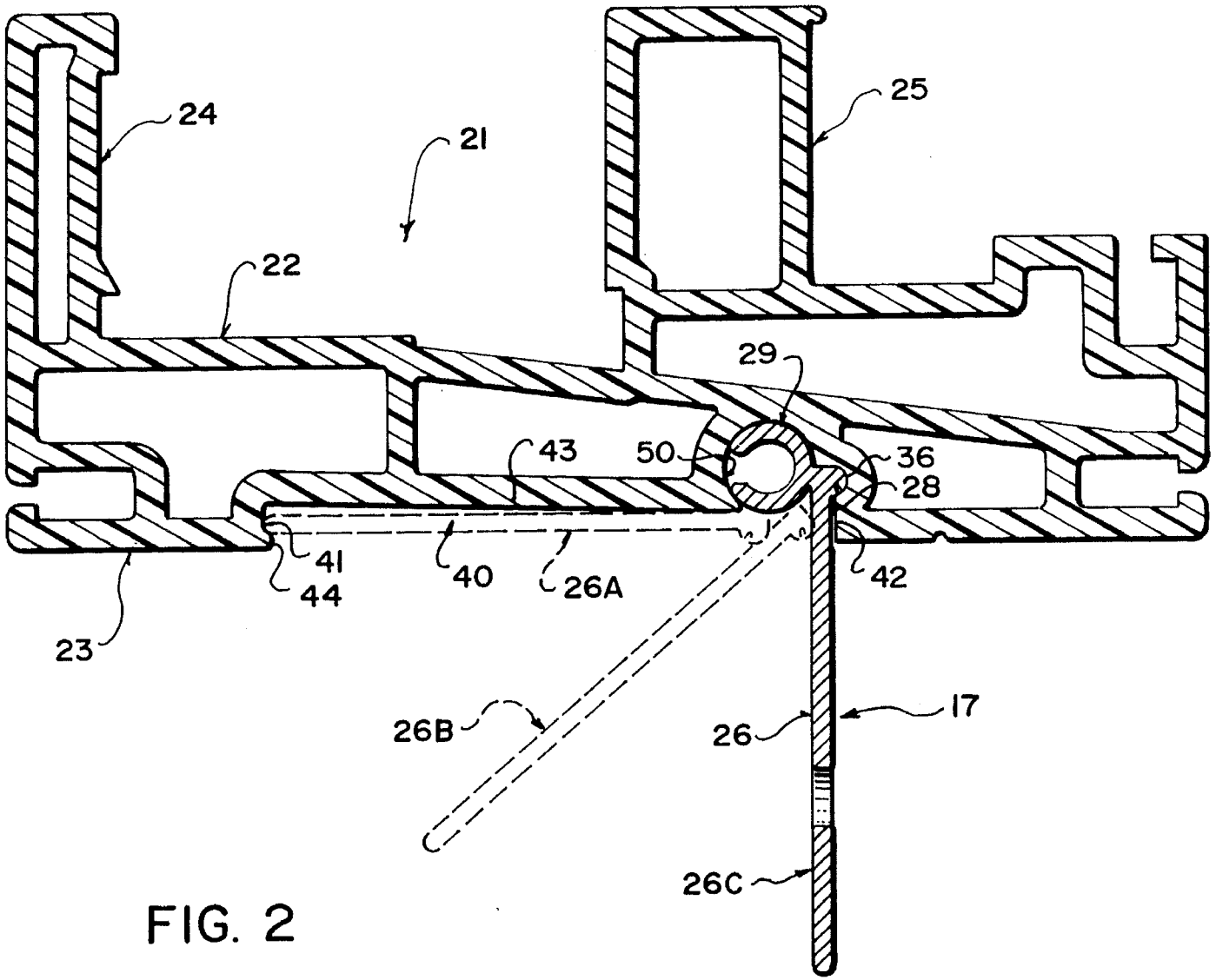
FIG. 2 is a cross sectional view along the lines 2—2 of FIG. 1 on an enlarged scale and showing the nailing strip in three separate positions.
Figure 3:
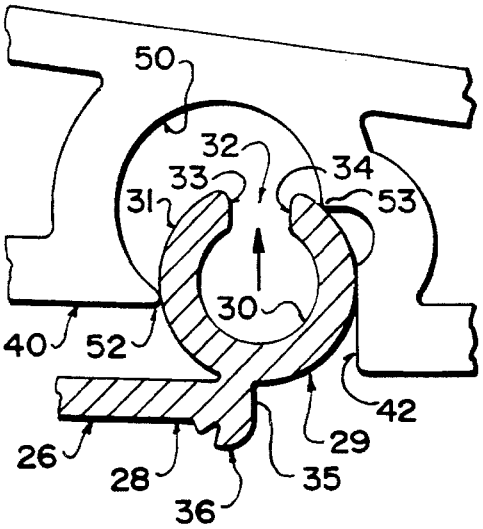
FIGS. 3, 4, 5 and 6 show an enlarged cross sectional view similar to that of FIG. 2 providing detail of the interconnection between the nailing strip and the window frame and showing the nailing strip in four separate positions.

In FIG. 1 is shown a conventional window frame of a very simple construction indicated generally at 10 and including a single window pane or glazing element 11. The frame 10 is formed from four separate frame members including two side members 12 and 13, a top member 14 and a bottom member 15 with the members being connected at corners 16 to form the frame structure. Each of the frame members carries a nailing strip 17 which, in the finished construction, is nailed to the outside face 18 of a building at an opening 19 so that the frame members are engaged into the opening and the nailing strip thus lie along the outer edge of the opening and are nailed along that outer edge with nails or other fasteners 20.

A cross section of one of the frame members and its associated nailing strip is shown in more detail in FIGS. 2 through 6. Thus the frame member is generally indicated at 21 in FIG. 2 and forms a complex extruded profile having an inner surface generally indicated at 22 for facing inwardly toward an opposed one of the frame members and an outer surface 23 for engaging the frame at the opening 19. The inner surface 22 includes two towers 24 and 25 for containing the glazing 11 (not shown).

The remaining structure of the profile is generally of a conventional nature apart from the relationship of the profile with the nailing strip which will be described in detail hereinafter. As the design of the profile can be modified to accommodate various requirements including sash sections and operating hardware, these details will not be described as they will be apparent to one skilled in the art.

The nailing strip 17 includes a planar strip member 26 with an outer edge 27 and an inner edge 28. The strip member is elongate so that it extends continuously along the length of the frame member. The nailing strip further includes a cylindrical bead member 29 attached at the edge 28 of the strip member. The construction is shown in enlarged scale in FIG. 3. In the enlarged scale it will be noted that the cylindrical bead member 29 is formed from a hollow tube having a hollow interior 30 and an outer cylindrical surface 31. A slot 32 is formed longitudinally of the tubular member so as to define edges 33 and 34 of the tubular member which may allow slight compression of the tubular member for distortion when required. The edge 28 of the strip member is attached to the cylindrical bead member by a flange 35 which is arranged on the outer surface 31 of the cylindrical bead member at a position generally opposite to the slot 32. The flange 35 extends generally radially outwardly from the outer surface 31 and the strip members arranged at right angles to the flange. The flange extends slightly beyond the strip member to form a bulbous nose 36 projecting radially outwardly from the cylindrical member.

The nailing strip 17 is extruded in continuous length from aluminum and cut to the required predetermined lengths for the different lengths of the frame members when required. The provision of the slot 32 assists in the forming process and this simplifies the construction of the mold as there are no closed parts of the nailing strip 17.

The outer surface 23 of the frame member is modified to receive the nailing strip thereon. In particular the outer surface is modified by the provision along the length thereof of a recess 40 which is wide and shallow for receiving the strip member 26. The recess is thus formed by side edges 41 and 42 together with a upper wall 43 dimensioned just to receive the strip member. The side 41 includes a lip 44 over which the edge 27 of the strip member must pass to enter the recess so that the lip forms a snap fastener to hold the strip member in position in the recess when pivoted to the position shown at 26A. The outer surface is further modified by the provision of a recess 50 for receiving a cylindrical bead member 29. The cylindrical recess 50 is best visible in FIG. 4 and is mounted on the outer surface at the end 42 of the recess 40. The cylindrical recess 50 defines a cylindrical surface 51 which commences at an apex 52 and extends around an inner surface to an end edge 53 adjacent the end 42. Between the edge 53 and the side 42 is provided a second subsidiary recess 54 which forms a shallow curved recess shaped to receive the bulbous nose 36 of the flange 35. In manufacture of the window frame, the frame member is extruded in continuous length from a suitable plastics material such as vinyl. The profile is then cut to length to provide the separate frame members which are connected at the corners 16.

Prior to shipment Of the finished window frame, the nailing strip is attached. The attachment is effected in a position shown in FIG. 3. Initially the strip member is pivoted so that it lies generally flat against the outer surface of the frame with the edge 27 in position behind the lip 44. In this position the cylindrical bead member 29 is moved toward the edge 42 and pressed along the edge 42 until the bead hits the apex 52. In this position the bead is outside the recess 50 and slightly outside of the position shown in FIG. 3. In the first step, therefore, the cylindrical bead member is pressed inwardly toward the recess 50 so that the apex 52 is slightly distorted or compressed and the outside surface of the bead member snaps over the apex 52 to a position shown in FIG. 3 in which the cylindrical bead member is bounded by the side 42, the edge 53 and the apex 52.

Figure 4:
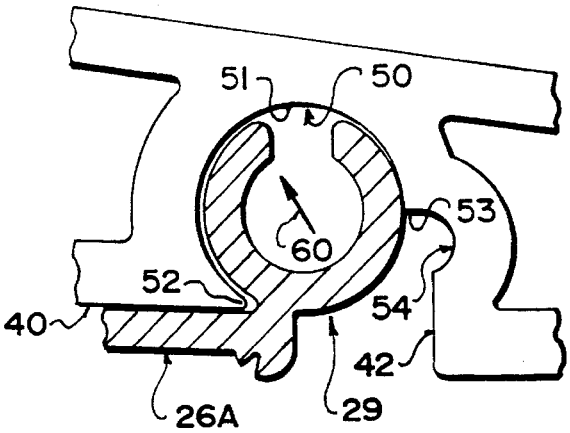
Figure 5:
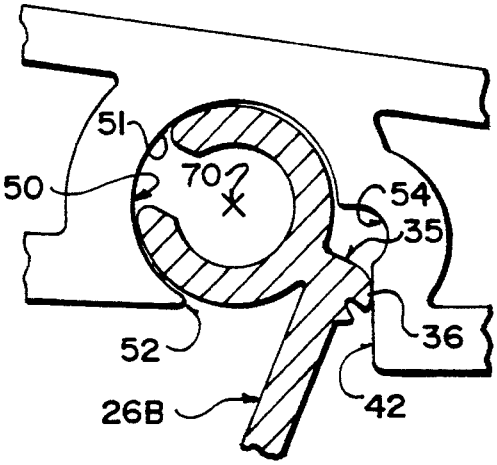
Figure 6:
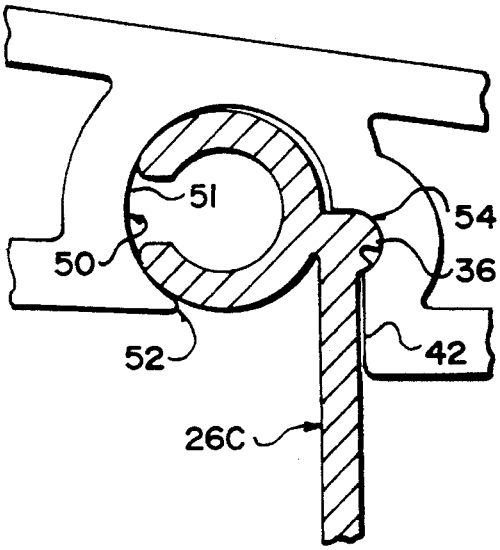

In the next step of assembly, force is applied in the direction of the arrow 60 in FIG. 4 so that the cylindrical bead member slightly distorts the apex 52 and the edge 53 to press them slightly apart sufficiently for the cylindrical bead member to pass between those two limitations and enter the cylindrical surface 51 of the recess 50. This movement moves the strip member slightly along the recess 40 toward the side 41 to ensure that the edge 27 of the strip member is retained by the lip 44 in a position shown in FIGS. 2 and 4.

With the nailing strip in the position thus assembled, the completed window frame is shipped and stored until ready for assembly into the building.

When it is required to assemble the structure, the nailing strip is moved from its storage position indicated at FIG. 26A through an intermediate position indicated at 26B to the erect position indicated at 26C. To initiate this movement, the strip member 26 is grasped generally by insertion of a tool from the ends of the strip member behind the strip member into the area of the recess 40 and is then popped out over the lip 44 to release the strip member to a position 26B. During this movement, the cylindrical bead member forms a first portion of a hinge structure with a second portion being provided by the recess 50 on the frame member. This rotation causes the bead member to rotate about a longitudinal axis 70 of the bead member until a position shown in FIG. 5 in which the nose 36 of the flange 35 hits the side 42 of the recess 40. Further movement caused by rotation of the nailing strip about the axis 70 causes the nose 36 to pop into the recess 54 which is shaped to receive the nose 36. This provides a snap action tending to hold the nailing strip in a position shown in FIG. 6. In this position the side 42 engages the right hand side face of the strip member to prevent further rotation of the strip member in the counter clock wise direction. This action is also enhanced by engagement of the flange 35 with the top of the recess 54. In this position the nailing strip is prevented from being pulled out of the recess 50 since the only movement available is vertically downwardly and this would require significant distortion of the apex 52 to allow the cylindrical bead to move both to the left and then downwards beyond the apex 52. This engagement therefore provides sufficient holding force to maintain the nailing strip in place.

The nailing strip is formed from aluminum which is of course therefore material dissimilar from the vinyl material of the frame and aluminum provides a more effective nailing strip since it is resistant to cracking due to penetration of nails or other fasteners or due to improper impact even in freezing temperatures.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A window frame for mounting in an opening defined by a framing support structure of a building, the window frame comprising:

a plurality of elongate frame members connected together at corners of the window frame, each member having an inner surface facing inwardly toward an opposed one of the members and an outer surface opposed to the inner surface for engaging the framing support structure, the inner surface of each member having glazing support members thereon;

each frame member having a nailing strip mounted on the outer surface thereof for extending along the length thereof and outwardly therefrom for attachment to the framing support structure along an edge of the opening;

the nailing strip of each frame member comprising:

an elongate substantially planar rigid strip member formed separately from the frame member;

means for mounting the separate strip member on the frame member including a projecting bead portion of the strip member along one edge thereof and an elongate recess in the frame member into which the bead portion extends;

the bead portion being rotatable relative to the elongate recess about an axis longitudinal of the frame member so as to provide for the strip member a first transport position substantially flat against the outer surface of the frame member and a second erect position extending outwardly from the outer surface substantially at right angles thereto;

the outer surface of the frame member including a shallow recess therealong having the elongate recess on one side, the shallow recess being shaped for containing the strip member lying flat therein in the transport position.

2. The window frame according to claim 1, wherein the strip member includes a first surface portion thereof and the frame member including a second surface portion thereof with the first and second surface portions arranged in the transport position to inter-engage to provide a retaining force therebetween tending to maintain the strip member in the transport position substantially flat against the outer surface of the frame, the first and second surface portions being arranged to allow passage of the strip portion into and from the transport position on application of a force greater than the retaining force by movement of the first surface portion over the second surface portion.

3. The window frame according to claim 1 wherein the shallow recess in the outer surface includes an elongate lip along an edge thereof opposite to the elongate recess for engaging an outermost edge of the strip member to locate the strip member in the transport position with the outermost edge snap fastened underneath the lip.

4. The window frame according to claim 1 wherein the strip member is formed from aluminum and the frame member is formed from extruded plastics material.

5. The window frame according to claim 1 wherein the bead portion is formed from a tubular body having a hollow interior and a slot along the tubular body.

6. The window frame according to claim 1 wherein at least one of the bead portion and the elongate recess is sufficiently deformable to allow the bead portion to be snap fastened into the recess.

7. The window frame according to claim 1 wherein the bead portion has a projecting flange extending substantially radially outwardly from an outer surface thereof and wherein the strip member is attached to one side surface of the flange so as to extend substantially at right angles to the flange.

8. The window frame according to claim 7 wherein the frame member includes a second subsidiary recess at the elongate recess for receiving the flange member therein to locate the strip member in the second erect position.

9. A window frame for mounting in an opening defined by a framing support structure of a building, the window frame comprising:

a plurality of elongate frame members connected together at corners of the window frame, each member having an inner surface facing inwardly toward an opposed one of the members and an outer surface opposed to the inner surface for engaging the framing support structure, the inner surface of each member having glazing support members thereon;

each frame member having a nailing strip mounted on the outer surface thereof for extending along the length thereof and outwardly therefrom for attachment to the framing support structure along an edge of the opening;

the nailing strip of each frame member comprising:

an elongate substantially planar rigid strip member formed separately from the frame member;

means for mounting the separate strip member on the frame member including a projecting bead portion of the strip member extending along one edge thereof and an elongate recess in the frame member into which the bead portion extends;

the bead portion being rotatable relative to the elongate recess about an axis longitudinal of the frame member so as to provide for the strip member a first transport position substantially flat against the outer surface of the frame member and a second erect position extending outwardly from the outer surface substantially at right angles thereto;

the strip member including a first surface portion thereof and the frame member including a second surface portion thereof with the first and second surface portions arranged in the transport position to interengage to provide a retaining force therebetween tending to maintain the strip member in the transport position substantially fiat against the outer surface of the frame, the first and second surface portions being arranged to allow passage of the strip portion into and from the transport position on application of a force greater than the retaining force by movement of the first surface portion over the second surface portion.

10. The window frame according to claim 9 wherein the second surface portion comprises an elongate lip for engaging an outermost edge of the strip member to locate the strip member in the transport position with the outermost edge snap fastened underneath the lip.

11. The window frame according to claim 9 wherein the strip member is formed from aluminum and the frame member is formed from extruded plastics material.

12. The window frame according to claim 9 wherein the bead portion is formed from a tubular body having a hollow interior and a slot along the tubular body.

13. The window frame according to claim 9 wherein at least one of the bead portion and the elongate recess is sufficiently deformable to allow the bead portion to be snap fastened into the recess.

14. The window frame according to claim 9 wherein the bead portion has a projecting flange extending substantially radially outwardly from an outer surface thereof and wherein the strip member is attached to one side surface of the flange so as to extend substantially at right angles to the flange.

15. The window frame according to claim 14 wherein the frame member includes a second subsidiary recess at the elongate recess for receiving the flange member therein to locate the strip member in the second erect position.

* * * * *